US005276421A

United States Patent [19]

Boitard

[11] Patent Number: 5,276,421

[45] Date of Patent: Jan. 4, 1994

[54] TRANSFORMER COIL CONSISTING OF AN INSULATING RIBBON COMPRISING ELECTRICALLY CONDUCTING PATTERNS MAKING IT POSSIBLE TO PRODUCE PARALLELING OF THE PATTERNS WHEN THIS RIBBON IS ACCORDION FOLDED

[75] Inventor: Pierre-Yves Boitard, St. Savine, France

[73] Assignee: Alcatel Converters, Paris, France

[21] Appl. No.: 913,938

[22] Filed: Jul. 17, 1992

[30] Foreign Application Priority Data

Jul. 17, 1991 [FR] France ..... 91 09037

[51] Int. Cl.[5] ..... H01F 27/30

[52] U.S. Cl. ..... 336/180; 336/183; 336/200; 336/232

[58] Field of Search ..... 336/200, 232, 180, 182, 336/183, 186

[56] References Cited

U.S. PATENT DOCUMENTS 2,911,605 11/1959 Wales, Jr. ..... 336/200

4,959,630 9/1990 Yerman et al. ..... 336/232

*Primary Examiner*—Thomas J. Kozma

*Attorney, Agent, or Firm*—Sughrue, Mion, Zinn, Macpeak & Seas

[57] ABSTRACT

Transformer coil consisting of an insulating ribbon comprising electrically conducting patterns making it possible to produce paralleling of the patterns when this ribbon is accordion folded.

According to the invention, one side of the insulating ribbon (25) alternately comprises one face (34; 36) with pattern (26; 27) and one face (35; 37) without pattern, each pattern (26, 27) comprising two paralleling pads (28, 29; 30, 31) prolonging each of its extremities beyond a separation line (P1, P3) in order to overlap onto the face (35; 37) without pattern in such a way that the paralleling pads (28, 29; 30, 31) of each pattern (26, 27) come into electrical contact with the extremities of the neighbouring pattern (26, 27) when the ribbon (25) is accordion folded, in such a way as to produce paralleling of the patterns (26, 27).

The invention applies especially to the production of high-frequency transformers used in switched-mode power supplies.

4 Claims, 3 Drawing Sheets

TRANSFORMER COIL CONSISTING OF AN INSULATING RIBBON COMPRISING ELECTRICALLY CONDUCTING PATTERNS MAKING IT POSSIBLE TO PRODUCE PARALLELING OF THE PATTERNS WHEN THIS RIBBON IS ACCORDION FOLDED

The field of the invention is that of transformer coils and more precisely that of coils consisting of strips of electrically-conducting material lying on an insulating ribbon.

In a known way, miniature electrical coils, especially those employed in high-frequency transformers used in switched-mode power supplies, are generally fabricated from copper ribbons whose thickness is close to the depth of penetration of the electric currents in the conductors, that is to say to the skin thickness. These copper ribbons are arranged on a sheet of insulating material, accordion folding of which makes it possible to obtain a coil. Intimate imbrication of a sheet comprising ribbons constituting the primary of a transformer with a sheet comprising turns for the secondary makes it possible to confer good electrical efficiency on such a transformer.

However, in the case where high currents are necessary in the secondary of the transformer, it is necessary to carry out paralleling of the turns of the secondary in order to limit the width of these turns and thus reduce the size of the transformer.

In effect, taking the example of a transformer having 8 turns in series in the primary and 1 turn in the secondary, for an input voltage of 48 volts, the turn of the secondary will theoretically see 6 volts at its extremities. For a primary current drawn of 1 ampere, the current flowing in the secondary turn is thus 8 amperes. Hence it is not possible to configure the secondary turn like the primary turns. The secondary turn must be thicker and wider than each of the primary turns.

In contrast, if the secondary consists of 8 turns in parallel, the current flowing in each turn is only 1 ampere, a much more reasonable value, whereas the secondary voltage is still 6 volts.

Hence it is easy to understand the usefulness of a parallel connection of the secondary turns of a high-frequency transformer which has to meet minimum bulk and significant power conditions.

Usually, paralleling of the turns of the secondary of a transformer of this type is produced by a remote connection, for example with the use of connecting wires such as shown in FIG. 1. This figure has been taken from ELECTRONIQUE DE PUISSANCE magazine No. 36, p. 46.

FIG. 1 shows the principle of connecting primary and secondary turns of a transformer. The patterns 10 to 17 of the transformer consist of a continuous strip of copper. These patterns are in series and folding them makes it possible to obtain four turns in series. The patterns 10 and 17 constitute the extremities and a primary voltage V1 can be applied to them. The secondary of the transformer consists of the individual turns 19 to 22. Each of the turns of the transformer is traversed by a magnetic circuit whose axis is referenced 18.

For the reasons set out above, the secondary turns of the transformer thus produced are connected in parallel with the use of pieces of wire 23, 24 in order to reduce the current flowing in the turns 19 to 22. Thus is obtained a voltage V2 at the secondary when the primary and secondary turns are imbricated into one another.

The main drawback of this type of transformer is that the paralleling of the turns of the secondary is produced by soldering and therefore limits the high-frequency performance characteristics. A wire connection furthermore gives rise to nonuniformity in the secondary current flows. Moreover, the parallel connection of the secondary turns is a delicate operation to carry out, given the size of these turns and the distance separating them once the insulating sheet is folded and fixed onto the former of the magnetic circuit.

This nonuniform connection principle is also encountered in transformers consisting of open turns mounted in a housing constituting the magnetic core, the connections of the turns being produced with the aid of conducting tracks on an electronic card onto which is fixed the magnetic core. The part of the turns produced by the printed circuit is not in the same plane as the rest of the turn and its efficiency is thus affected by this. The fact of connecting one turn to the other, moreover, increases the length of the connections of the secondary of the transformer.

The objective of the present invention is especially to alleviate these drawbacks.

More precisely, one of the objectives of the invention is to furnish a transformer coil permitting simple paralleling of the turns of this coil, which reduces the connection lengths outside the useful areas of the turns, these connections possibly being produced homogeneously, that is to say without applying soldering or additional connections.

Another objective of the invention is to simplify the fabrication process of such a winding and hence of a transformer using such a winding.

A supplementary objective is to limit the insulation volumes of such a transformer, so as to reduce its bulk, while ensuring optimal imbrication of the primary and secondary turns.

These objectives, as well as others which will appear below, are achieved by virtue of a transformer coil, of the type consisting of an insulating ribbon comprising, on one of its sides, patterns consisting of strips of electrically conducting material, the insulating ribbon being accordion folded, in order to constitute the coil, along equidistant separation lines delimiting faces of the insulating ribbon, each pattern lying between two separation lines constituting one turn of the coil, this coil being characterised in that this side of the ribbon alternately comprises one face with pattern and one face without pattern, each pattern comprising two paralleling pads prolonging each of its extremities beyond a separation line in order to overlap onto the face without pattern in such a way that the paralleling pads of each pattern come into electrical contact with the extremities of the neighbouring pattern when the insulating ribbon is accordion folded, in such a way as to produce paralleling of the patterns.

This paralleling of the patterns is thus obtained by simple accordion folding of the ribbon and is accompanied by insulation between the turns, by virtue of the faces without patterns.

The invention also relates to a transformer coil consisting of an insulating ribbon comprising alternately two faces carrying a group of two patterns in series and two faces without pattern comprising linking pads for the groups of patterns, the linking pads extending on either side of the separation line delimiting the two faces without pattern, each group of patterns comprising two paralleling pads prolonging each of its extremities beyond the separation line situated between the two patterns of the group, the paralleling pads of each pattern group coming into electrical contact with the extremities of the neighbouring pattern group by means of the linking pads when the insulating ribbon is accordion folded, in such a way as to produce paralleling of the groups of patterns.

It is thus possible to produce paralleling of patterns in series.

Advantageously, one of the coils as identified above constitutes one of the coils of a transformer, the other side of the insulating ribbon comprising patterns constituting the other coil of the transformer when the insulating ribbon is accordion folded. Thus is obtained optimal imbrication of the primary and of the secondary and minimised bulk.

The invention also relates to a transformer produced from such a coil.

Other characteristics and advantages of the invention will appear on reading the following description of two preferential embodiments, given by way of illustration and not limiting, and the attached drawings in which.

Figure 1:
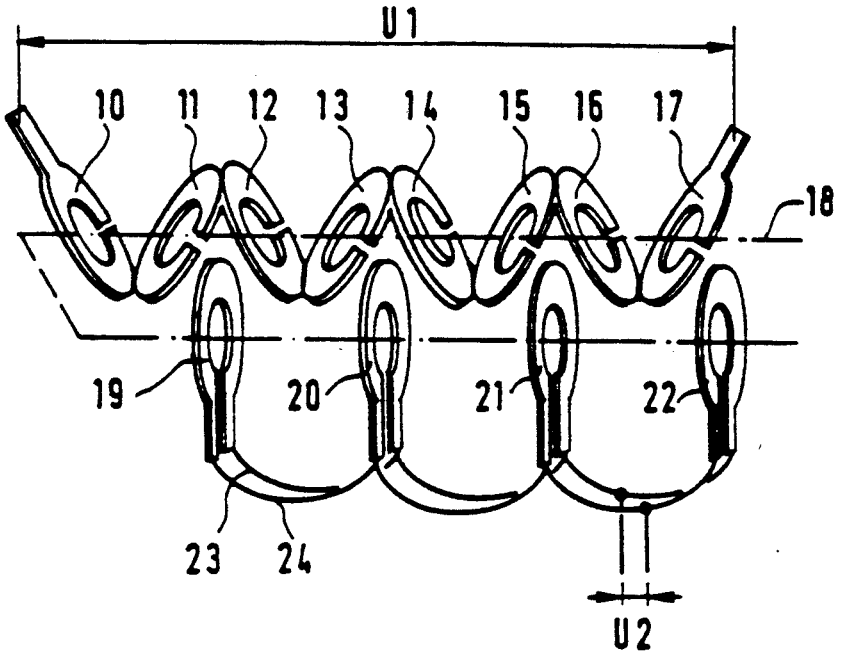
FIG.1 PRIOR ART
FIG. 1 shows a known principle for parallel linking of turns of a high-frequency transformer.

FIG. 1 has been described with reference to the state of the art.

Figure 2:
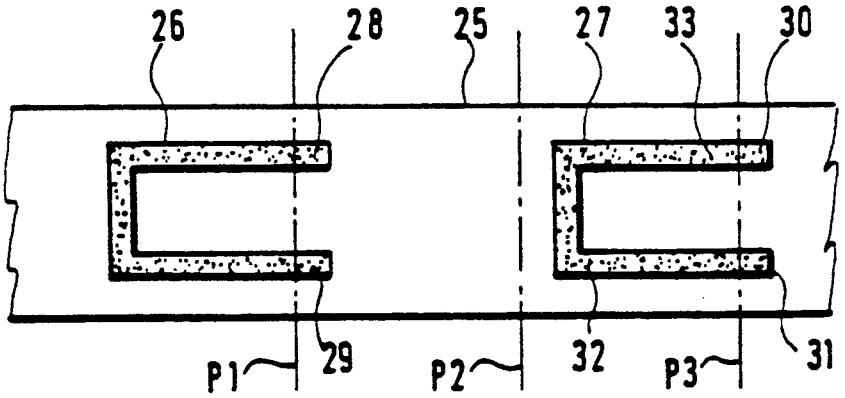
FIG. 2 shows an insulating ribbon comprising, on one of its sides, patterns of electrically conducting material, according to one embodiment of the invention.

FIG. 2 shows an insulating ribbon comprising, on one of its sides, patterns of electrically conducting material, according to one embodiment of the invention.

An insulating ribbon 25, only a part of which is shown, comprises, on one of its sides, patterns 26, 27 of electrically conducting material. These patterns are produced, for example, by a chemical etching method. The insulating ribbon 25 is, for example, made of Kapton and the patterns 26, 27 of copper. The ribbon 25 is intended to be folded along equidistant separation lines P1, P2, P3. Each pattern 26, 27 corresponds to one turn of the winding produced by folding the ribbon 25, as will be detailed below.

According to the invention, with the aim of producing paralleling of the patterns of the ribbon, paralleling pads 28, 29, 30, 31 each prolong patterns 26, 27 of the ribbon 25, this prolongation taking place up to beyond the separation lines P1 and P3, in such a way that the paralleling pads 28 and 29, prolonging the extremities of the pattern 26, come into contact, after the ribbon 25 has been folded, with the extremities 32 and 33 of the pattern 27. This paralleling of the patterns will be better understood on reading the following description of FIG. 3.

Figure 3:
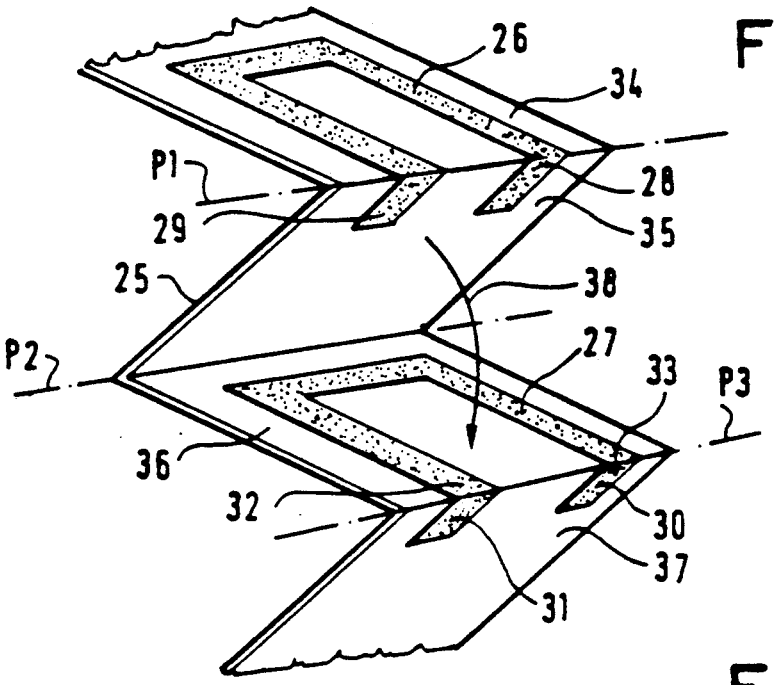
FIG. 3 shows the accordion folding of the insulating ribbon of FIG. 2.

FIG. 3 shows the accordion folding of the ribbon of FIG. 2.

Accordion folding of the insulating ribbon 25 is carried out along the folds P1 to P3, each folding taking place in the opposite direction to the preceding one. The face 34 comprises the turn 26, the face 35 the paralleling pads 28, 29 of the turn 26, the face 36 the turn 27 and the face 37 the paralleling pads 30, 31 of the turn 27. The faces 34, 36 comprising patterns are alternated with the faces 35, 37 without pattern. During folding, carried out along a direction 38, face 35 comes into contact with face 36 and the paralleling pads 28 and 29 of turn 25 come into contact with the extremities 32 and 33 of turn 27.

Paralleling of the turns is thus produced automatically, without it being necessary to add connecting wires after folding. Moreover, it is not necessary to insert an insulating ribbon between the faces during folding, this insulation being contributed by the absence of patterns on the faces situated between the faces comprising patterns. Thus is obtained a lower bulk for the coil than that shown by the coils of the state of the art.

The paralleling pads 30 and 31 of turn 27 similarly come into contact with the extremities of a turn situated on a face with which face 37 comes into contact by folding. It is thus possible to produce paralleling of a large number of individual turns of a transformer coil.

Figure 4:
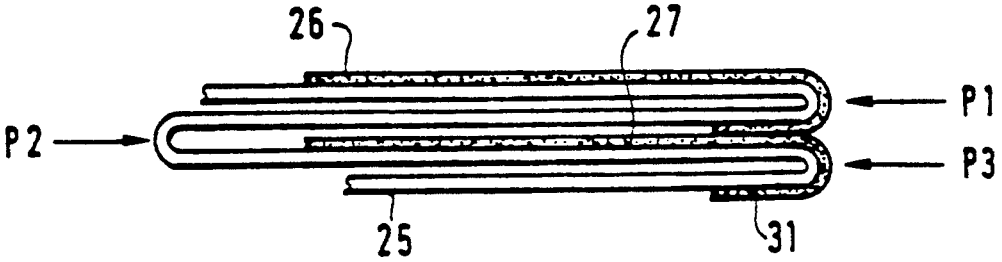
FIG. 4 is a side view of the insulating ribbon of FIGS. 2 and 3 completely folded.

FIG. 4 is a side view of the insulating ribbon of FIGS. 2 and 3 entirely folded.

Accordion folding ensures paralleling of turns 26 and 27. Access to the coil turns is easy, given that at the site of folds P1 and P3 the conducting tracks are visible.

The turns of the ribbon can either be held in contact by pressure in a transformer, or soldered after folding in order to ensure optimum contact between the turns.

According to a preferential embodiment, the insulating ribbon is made of Kapton and measures between 50 and 75 μm thick and the copper has a thickness of about 75 μm.

Figure 5:
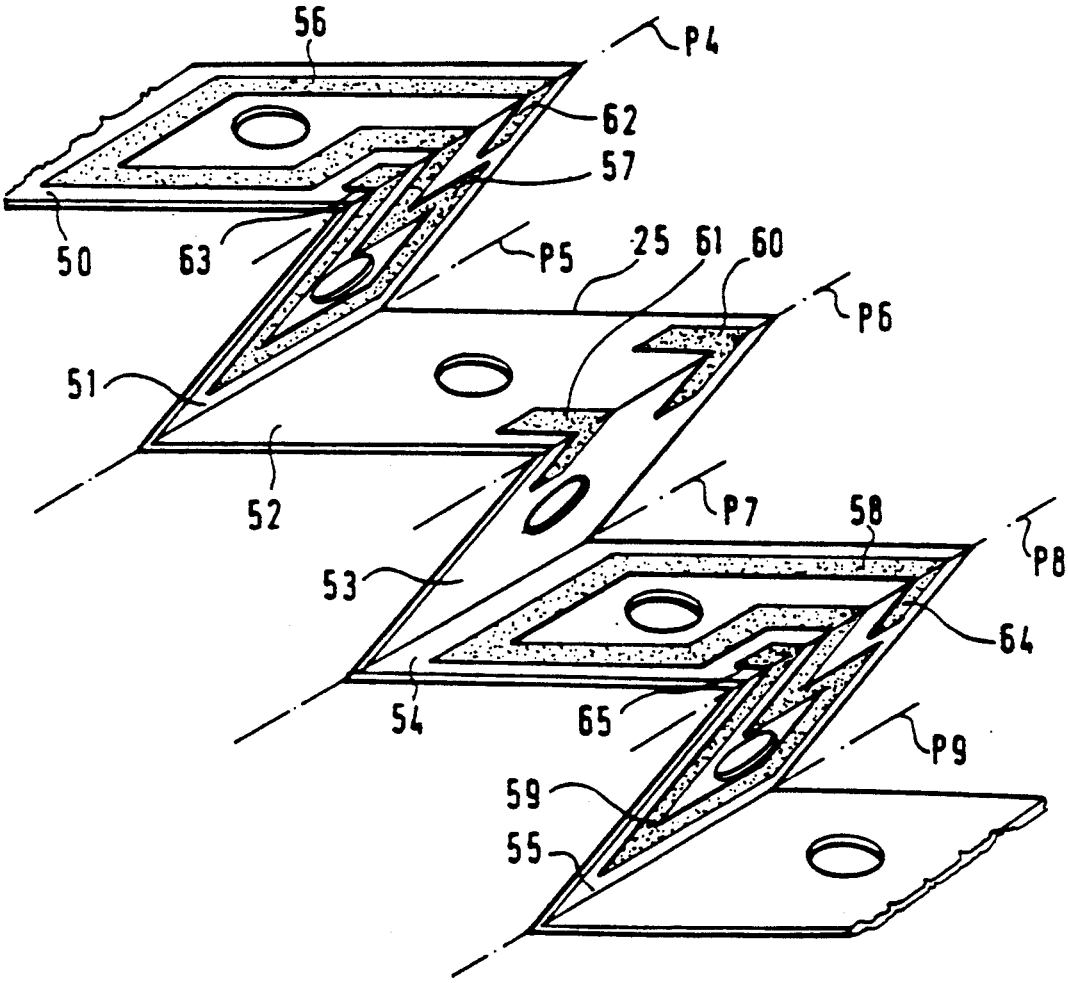
FIG. 5 is an exemplary embodiment of paralleling of groups of two turns in series.

Needless to say, the parallelled turns are not necessarily individual. Hence, for one configuration of the different turns, it is possible to parallel groups of several turns. FIG. 5 is an exemplary embodiment of a paralleling of groups of two turns in series.

The insulating ribbon 25 comprises silk screen printed patterns consisting of two turns in series. Hence, faces 50, 51, 54 and 55 each comprise one turn, respectively referenced 56, 57, 58 and 59. Turns 56 and 57 are in series, as are the neighbouring turns 58 and 59, this series connecting of the turns being provided by conducting tracks. Faces 52 and 53 of the ribbon 25 comprise only linking pads 60, 61 extending on either side of the fold P6.

Turns 56 and 57 form a group of turns whose extremities are prolonged by paralleling pads 62 and 63 extending beyond the fold P4 in opposite directions.

During folding of the ribbon 25, the paralleling pad 62 comes into contact with the part of the linking pad 60 situated on face 52 and the part of the linking pad 60 situated on face 53 comes into contact with the extremity of turn 58. The same applies for the paralleling pad 65 of face 54 which comes into contact with the extremity of turn 57 via linking pad 61.

The folding carried out, associated with a specific configuration of the turns, hence makes it possible to parallel groups of two turns in series. The paralleling pads 63 and 64 come into contact with linking pads situated respectively above and below the turns shown.

Needless to say the number of turns in series in a group is not limited to two. Different configurations of the turns make it possible to parallel groups consisting of a large number of turns in series.

In this embodiment, insulation between the turns is also automatically obtained by accordion folding the ribbon, since faces 52 and 53 do not comprise a pattern constituting a turn.

The non-referenced orifices pierced in the centre of each face permit a magnetic circuit to be passed through. These orifices are also present, but not shown on the first embodiment (FIGS. 2 and 3).

Needless to say, extending the paralleling pads over the fold can also serve for connecting turns in series. This embodiment also permits a reduction in the lengths of the conductors. The patterns, however, exhibit more complex shapes. It is then necessary to insulate some copper surfaces in order avoid short circuits, production of the coil being for this reason more complex.

As described above, the ribbon 25 comprising the patterns constituting turns is intended to be imbricated with another ribbon. This other ribbon may, for example, comprise turns in series, and constitute the primary of a transformer, the secondary being produced by paralleling turns in accordance with the invention.

This known embodiment, however, exhibits the drawback of exhibiting variable efficiency, according to whether the ribbons are more or less well imbricated.

For this reason the primary and the secondary of the transformer are preferentially produced on the same insulating ribbon. One side of the insulating ribbon comprises the turns constituting the primary winding and the other side those constituting the secondary winding. During fabrication of the ribbon, it is then easy to arrange the turns in such a way that optimal primary-secondary imbrication is ensured.

Moreover, the orifices for the passage of the magnetic circuit need be produced only once.

Figure 6:
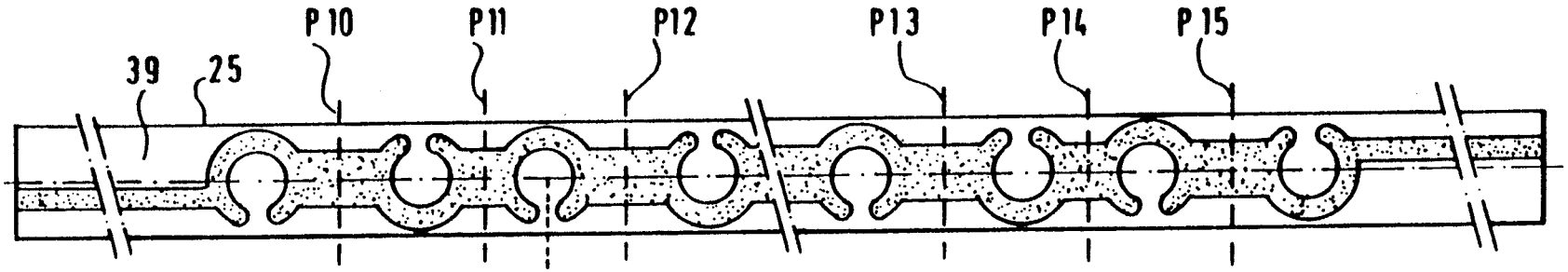
FIGS. 6 and 7 represent the two sides of an insulating ribbon comprising patterns according to one embodiment of the coil according to the invention.
Figure 7:
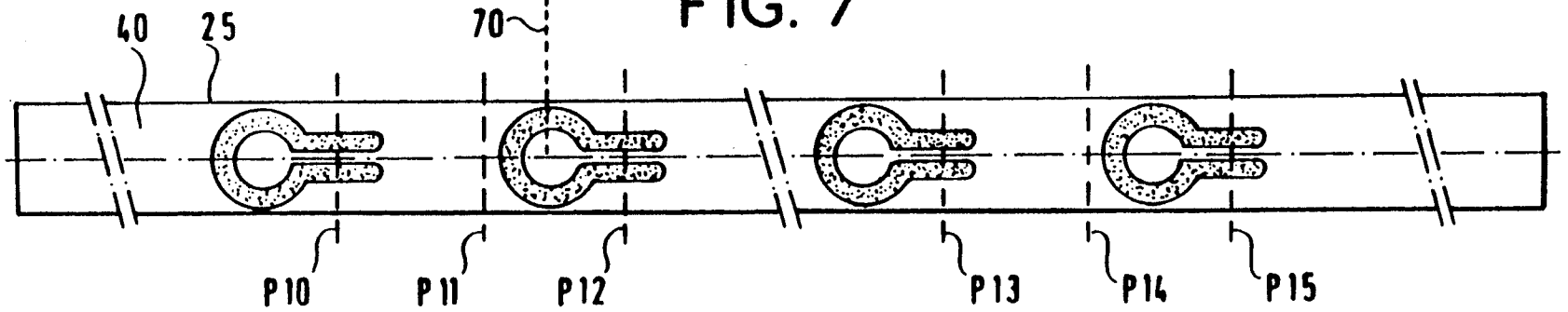

FIGS. 6 and 7 show the two sides of such an insulating ribbon.

On a first side of the ribbon 25, represented in FIG. 6, the patterns are put in series by prolonging the conducting strips from one pattern to the next. Each pattern consists of a turn which will be traversed by a cylindrical bar constituting the magnetic circuit. The ribbon 25 is intended to be folded along folds P10 to P15.

The opposite side of the ribbon 25 comprises the patterns represented in FIG. 7. These patterns are intended to be connected in parallel by folding and consist of individual turns.

It will be noted, with regard to FIG. 6, that the folds P10 to P15 produced permit the paralleling pads prolonging the extremities of the patterns of FIG. 7 to overlap. Moreover, as shown by the broken lines 70, the patterns of FIG. 7 are opposite a pattern for every other pattern of FIG. 6.

When the folded insulating ribbon 25 is inserted into a magnetic circuit, the folds P10, P12, P13 and P15 are accessible from the outside of the transformer, especially in order to solder the turns if the ribbon is not sufficiently compressed, so as to ensure sufficient and permanent contact of the superimposed turns.

The transformer coil according to the invention thus permits maximum reduction in the lengths of the conductors, which is essential when working frequencies are high, absence of soldered connections when the folded ribbon is sufficiently compressed, simplification in assembly of the transformer and limitation of the insulation volumes.

I claim:

1. In a transformer coil comprising an insulating ribbon, strips of electrically conducting material on one side of said insulating ribbon and forming patterns, said insulating ribbon being accordion folded to constitute said coil along equidistant separation lines delimiting faces of said insulating ribbon, each of said patterns lying between two separation lines constituting one turn of said coil, the improvement wherein said one side comprises alternately, one of said faces with said pattern and one of said faces without said pattern, each pattern comprising two paralleling pads prolonging each extremity beyond a separation line in order to overlap onto said one face without a pattern such that said paralleling pads of each pattern come into electrical contact with extremities of a neighboring pattern when said insulating ribbon is accordion folded to produce paralleling of said patterns.

2. In a transformer coil comprising an insulating ribbon having opposite sides, one of said sides having patterns of strips of electrically conducting material, said insulating ribbon being accordion folded along equidistant separation lines delimiting faces of said insulating ribbon, each of said patterns lying between two separation lines constituting one turn of said coil, the improvement wherein said one side alternately comprises two of said faces carrying a group of two said patterns in series and two of said faces without patterns comprising linking pads for said group of patterns, said linking pads extending on either side of a separation line delimiting said two faces without patterns, each group of patterns comprising two paralleling pads prolonging extremities beyond a separation line situated between said two patterns of said groups, said paralleling pads of each pattern group coming into electrical contact with extremities of a neighboring pattern group by mean of said linking pads when said insulating ribbon is accordion folded so as to produce paralleling of said groups of said patterns.

3. A coil according to claim 1, constituting one of plural coils of a transformer, and wherein an other side of said insulating ribbon comprises patterns constituting said other coil of said transformer when said insulating ribbon is accordion folded.

4. A coil according to claim 2, constituting one of plural coils of a transformer, and wherein an other side of said insulating ribbon comprises patterns constituting said other coil of said transformer when said insulating ribbon is accordion folded.

* * * * *